US008449050B2

(12) United States Patent
Karg

(10) Patent No.: US 8,449,050 B2
(45) Date of Patent: May 28, 2013

(54) ARTICLE OF FURNITURE HAVING A DRAWER AND A CURRENT CONSUMER

(75) Inventor: David Karg, Bregenz (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/038,592

(22) Filed: Mar. 2, 2011

(65) Prior Publication Data

US 2011/0193454 A1 Aug. 11, 2011

Related U.S. Application Data

(63) Continuation of application No. PCT/AT2009/000282, filed on Jul. 17, 2009.

(30) Foreign Application Priority Data

Sep. 3, 2008 (AT) ..... A 1367/2008

(51) Int. Cl.
*A47B 97/00* (2006.01)

(52) U.S. Cl.
USPC ..... 312/223.6

(58) Field of Classification Search
USPC ..... 312/223.5, 223.6, 330.1, 334.7, 348.6
See application file for complete search history.

(56) References Cited

U.S. PATENT DOCUMENTS

| | | | | |
|---|---|---|---|---|
| 3,256,479 | A | 6/1966 | Edwards | |
| 3,506,325 | A * | 4/1970 | Horvay | 312/223.5 |
| 4,592,602 | A | 6/1986 | Kuster et al. | |
| 5,057,978 | A * | 10/1991 | Conti | 362/125 |
| 5,246,285 | A * | 9/1993 | Redburn et al. | 312/223.5 |
| 5,276,310 | A * | 1/1994 | Schmidt et al. | 219/521 |
| 5,437,504 | A * | 8/1995 | Halvatzis | 362/125 |
| 2002/0171335 | A1 | 11/2002 | Held | |
| 2003/0002261 | A1 | 1/2003 | Berry et al. | |
| 2005/0236946 | A1 * | 10/2005 | LeClear et al. | 312/348.3 |
| 2006/0126325 | A1 * | 6/2006 | Lefebvre et al. | 362/217 |
| 2007/0145867 | A1 | 6/2007 | Gasser | |
| 2007/0180654 | A1 * | 8/2007 | Gasser | 16/242 |
| 2008/0290774 | A1 * | 11/2008 | Gasser et al. | 312/330.1 |
| 2009/0206715 | A1 | 8/2009 | Scheffknecht et al. | |

FOREIGN PATENT DOCUMENTS

| | | |
|---|---|---|
| EP | 0 129 695 | 1/1985 |
| EP | 707818 | * 6/1995 |
| EP | 1 260 158 | 11/2002 |
| EP | 1 399 800 | 3/2007 |
| WO | 2006/017865 | 2/2006 |
| WO | 2007/098515 | 9/2007 |

OTHER PUBLICATIONS

International Search Report issued Nov. 5, 2009 in International (PCT) Application No. PCT/AT2009/000282.
Austrian Patent Office Search Report completed May 8, 2009 issued in Austrian Patent Application No. A 1367/2008.

* cited by examiner

*Primary Examiner* — James O Hansen
*Assistant Examiner* — Matthew Ing
(74) *Attorney, Agent, or Firm* — Wenderoth, Lind & Ponack, L.L.P.

(57) ABSTRACT

A carrier element can be attached to a furniture body of a piece of furniture, in which a current consumer is disposed in or on a furniture part movable in the piece of furniture, particularly a drawer. At least one power supply unit for the current consumer is disposed—preferably releaseably—on the carrier element.

11 Claims, 21 Drawing Sheets

ARTICLE OF FURNITURE HAVING A DRAWER AND A CURRENT CONSUMER

This application is a Continuation of International Application No. PCT/AT2009/000282, filed Jul. 17, 2009, the entire disclosure of which is incorporated herein by reference.

BACKGROUND OF THE INVENTION

The invention concerns an article of furniture with a furniture carcass, a carrier element which can be mounted to the furniture carcass, and a movable furniture portion, in particular a drawer. A current consumer is arranged in or on the movable furniture portion.

Carrier elements for articles of furniture or furniture portions are already known, and supplying current to the current consumer occurs as a serious problem in production and use of such articles of furniture. For that purpose, EP 1 260 158 A2 already discloses a furniture drawer having a chargeable current storage device which is arranged on the drawer and which can be charged up by way of a transfer device arranged on the furniture carcass. A problem which arises in that respect, however, is mounting the power supply unit to the furniture carcass, which mounting has to be fixedly planned for the furniture carcass to correspond to the arrangement of the drawers. In addition, the power supply units have in part complicated cables arranged along or in the furniture carcass.

SUMMARY OF THE INVENTION

Therefore, the object of the present invention is to provide a simpler and improved power supply for current consumers in drawers.

According to the invention, that object is attained in that at least one power supply unit for the current consumer is arranged—preferably releasably—on the carrier element. It is admittedly known for such a carrier element to be mounted to the furniture carcass, but that carrier element serves only for holding the ejector for the drawer (see in that respect WO 2006/017865). The power supply unit can be releasably mounted or snap-fitted on such a carrier element for example by way of a clamping stirrup.

In a preferred embodiment, arranged in or on the carrier element is an electric line which is connected to an external power source and which can be connected to the power supply unit. The electric lines can extend in such a carrier element, while the power supply unit can also be contacted with such a line. When the power supply unit is mounted to the carrier element, electrical contact can be automatically effected with the line. In accordance with a further embodiment, the power supply unit can contact the electric line with piercing pins. Alternatively, it is also possible for the electric line to be guided in or on the furniture carcass, in which case, when mounting the power supply unit to the carrier element, automatic contact can be made between the power supply unit and the electric line arranged in or on the furniture carcass, for example by way of a plug.

Preferably, the current consumer can be a lighting device, wherein the lighting device lights up the internal space of the drawer preferably entirely. For example, the lighting device can be arranged on the rear wall of the drawer. The current supply for displays or other current consumers in any region of the drawer can be effected by the present invention.

To be able to guarantee the constant current supply, a chargeable current storage means can be arranged in or on the movable furniture portion, and the power supply unit charges up the current storage means by way of contact locations in the closed position of the movable furniture portion. In that respect, it is advantageous if the power supply unit charges up the current storage means only in the closed position and the electrical connection between the power supply unit and the current storage means is separated when the movable furniture portion is opened. Preferably, the current storage means is connected to the current consumer and supplies the current consumer with current in the opened position of the movable furniture portion.

As already indicated, a preferred variant can provide that the movable furniture portion is movable by a spring-loaded and/or electrically driven ejector device which is mounted to the carrier element. In that case, when the ejector device is mounted to the carrier element, electrical contact with respect to the line can automatically be effected. Once again, it can advantageously be provided that when the ejector device is mounted to the carrier element, electrical contact is effected automatically with the line, in which case the ejector device contacts the electric line with piercing pins.

In a preferred embodiment, the carrier device carries at least an ejector device and a power supply unit and the ejector device and the power supply unit are associated with the same movable furniture portion. Alternatively, the carrier element can carry at least a power supply unit and an ejector device which correspond to different movable furniture portions.

The carrier element is preferably arranged in a vertical orientation at the rear region of the inside of the furniture carcass. That, however, is not intended to exclude other orientations and ways of mounting the carrier element in the region of the article of furniture being possible. In addition, it is also possible to provide for adjustability of the carrier element from and to the furniture carcass.

The basic idea of the present invention is using a carrier element which is already known (also) for the current supply for a current consumer arranged in or on a drawer. What is advantageous in that respect is in particular the modular option of using the carrier element for the power supply unit, the ejector and so forth which correspond to the respectively desired drawers and which can be brought without using a tool into current-conducting contact with an electric line which is preferably integrated in the carrier element.

BRIEF DESCRIPTION OF THE DRAWINGS

Further details and advantages of the present invention will be described more fully hereinafter by the specific description and with reference to the embodiments illustrated in the drawings, in which.

DETAILED DESCRIPTION OF THE INVENTION

Figure 1:
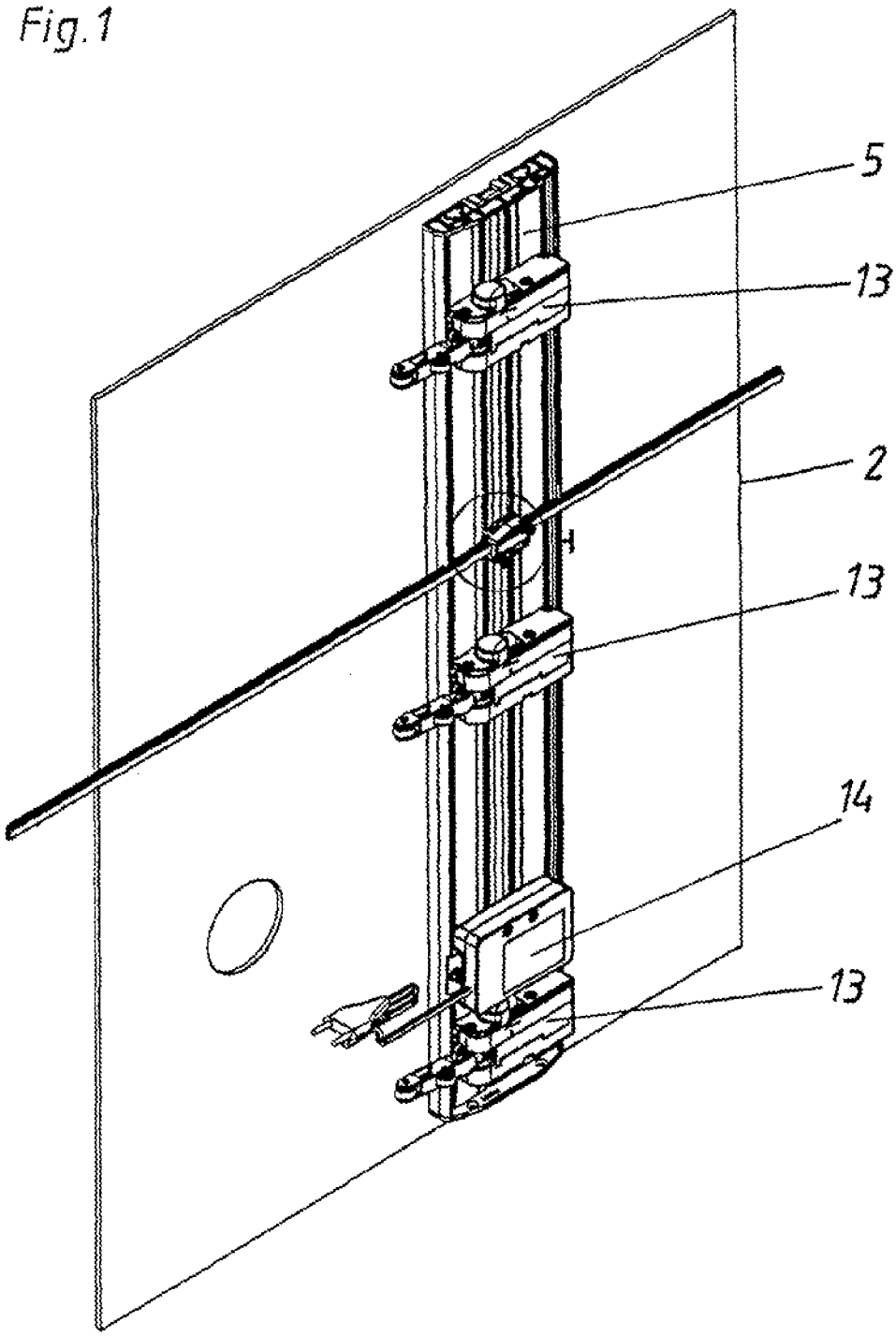
FIG. 1 shows a carrier element from the state of the art.

FIG. 1 shows the inside of the rear wall of an article of furniture in accordance with the state of the art, wherein ejector devices 13 and a transformer 14 are mounted to the carrier element 5. The carrier element 5 is mounted in a vertical orientation to the furniture carcass 2.

Figure 2:
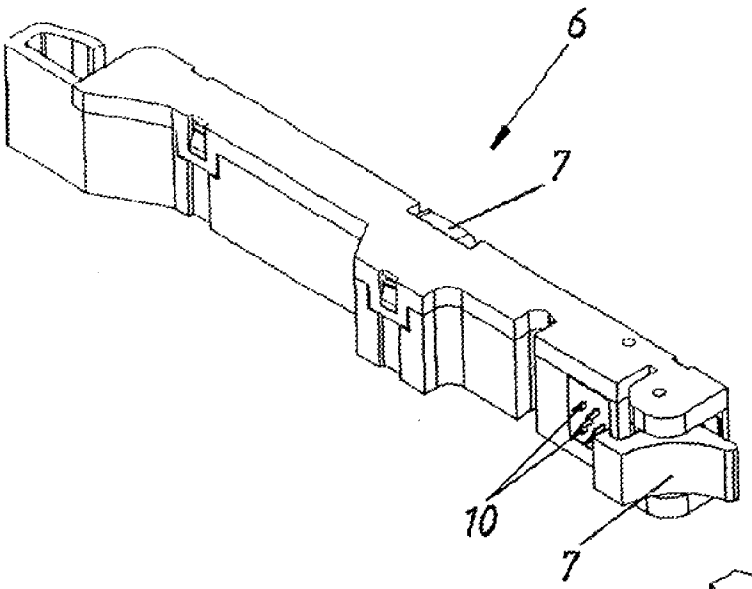
FIGS. 2 through 4 show views of power supply units.
Figure 3:
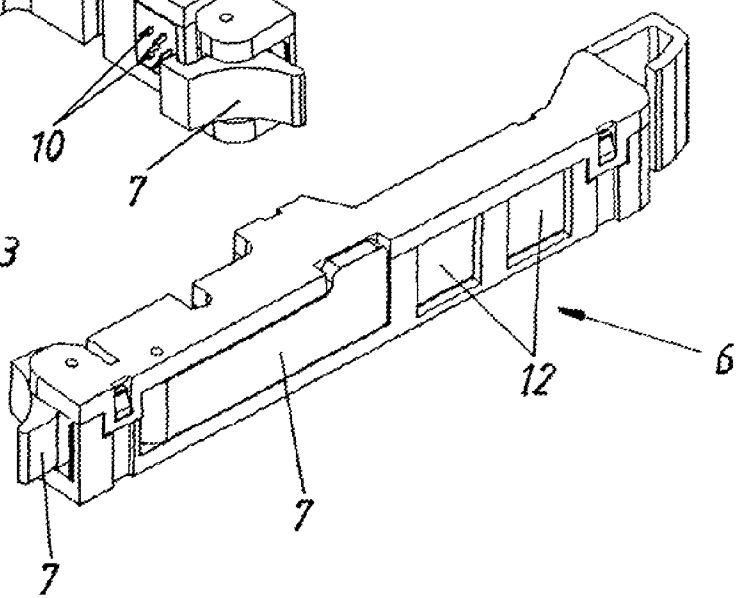
Figure 4:
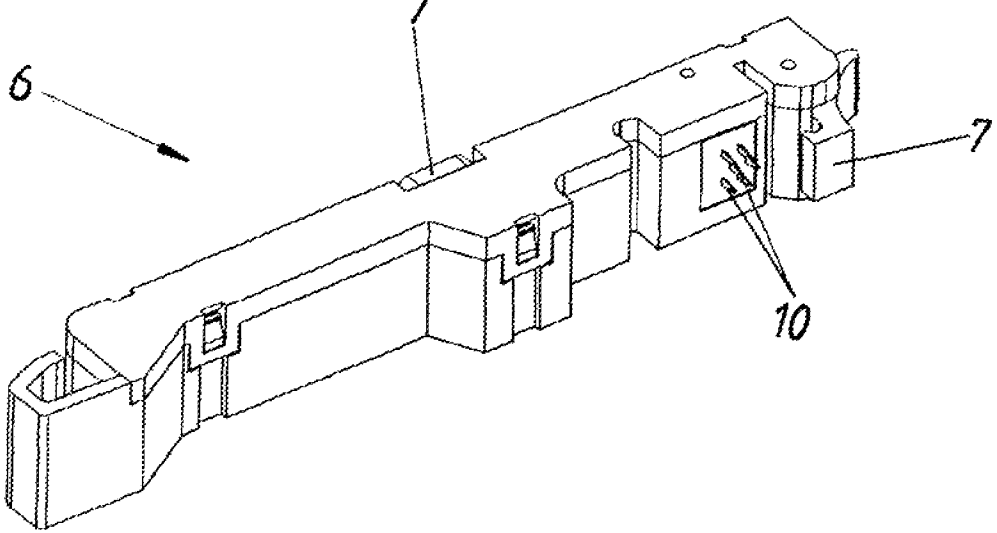

FIGS. 2 through 4 show power supply units 6 having a clamping stirrup 7 by way of which the power supply units 6 are mounted to a carrier element 5 (not shown here). Upon mounting, the piercing pins 10 afford a current-conducting connection to an electric line. In that respect, FIG. 3 shows the contact locations 12 which involve a current storage means 11 described hereinafter, and a current-conducting connection can thus charge up the current storage device 11.

Figure 5:
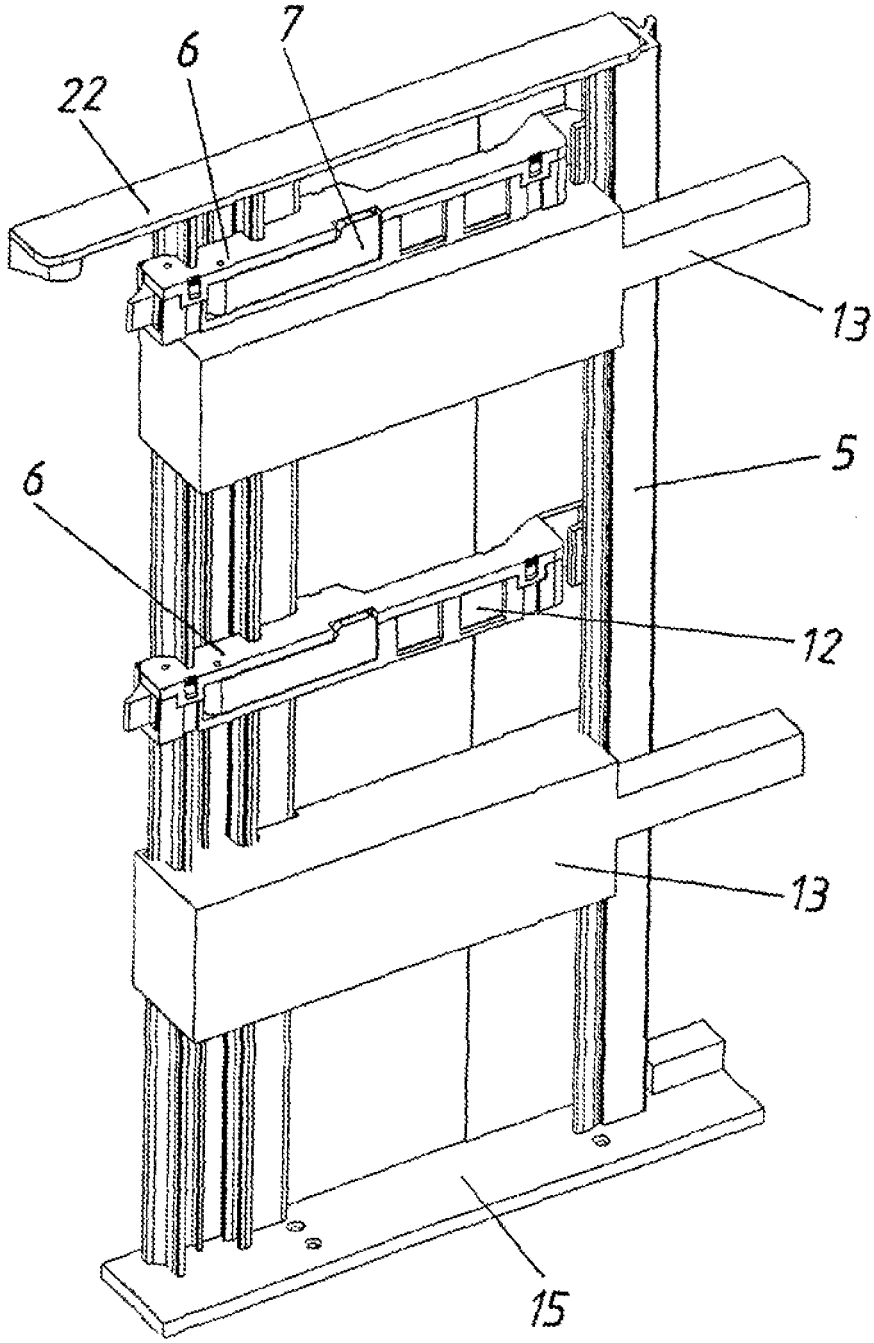
FIGS. 5 and 6 show views of the carrier element with ejector devices and power supply units.
Figure 6:
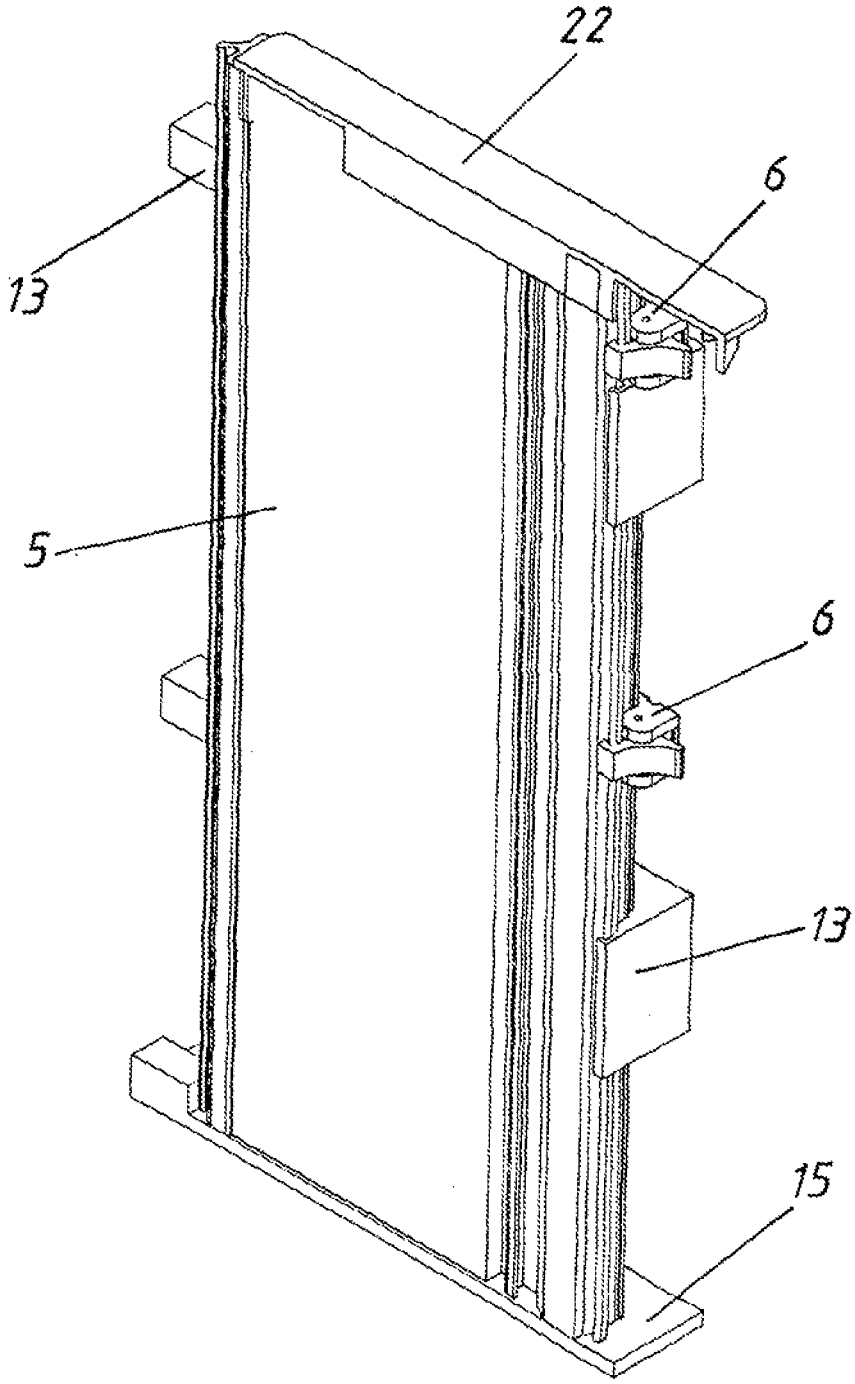
Figure 7:
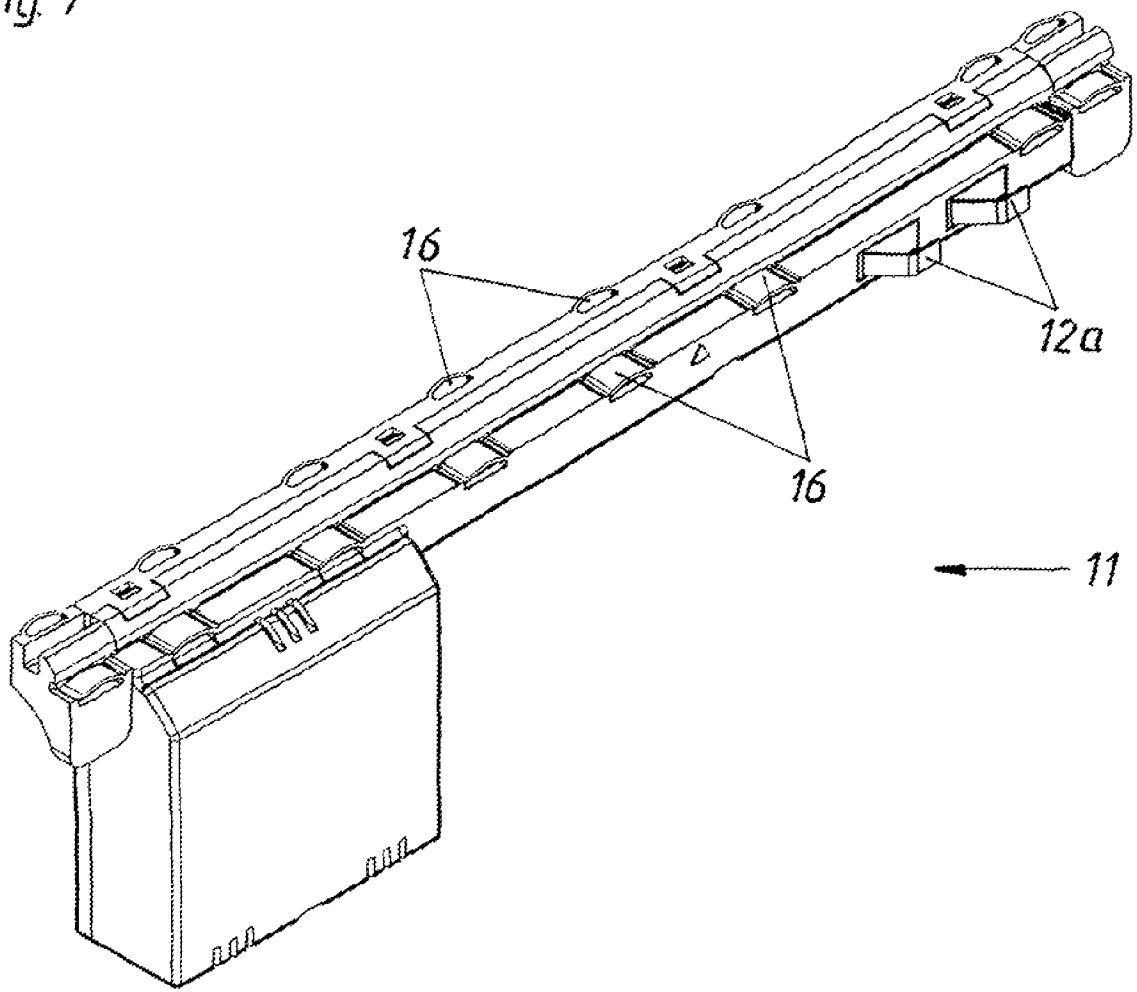
FIGS. 7 through 10 show views of a current storage means.
Figure 8:
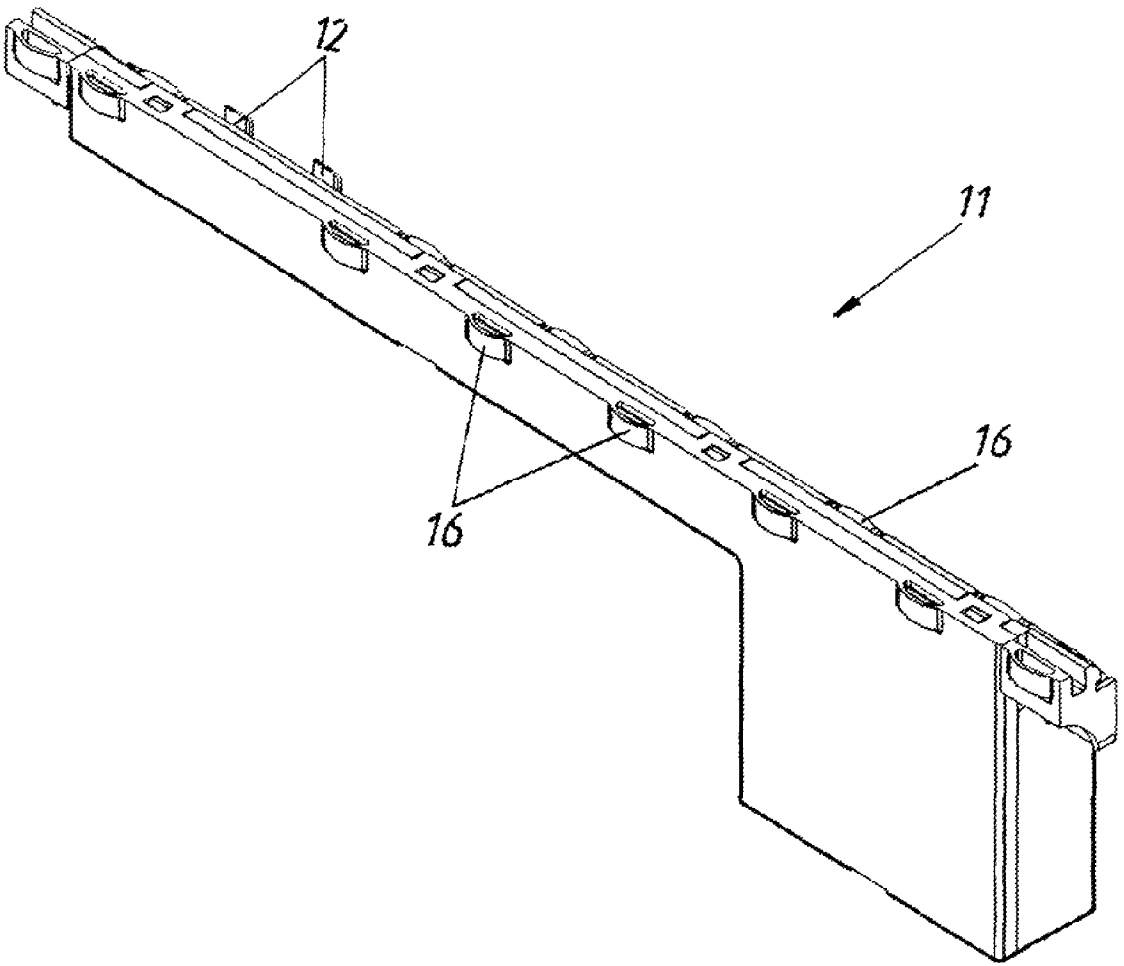
Figure 9:
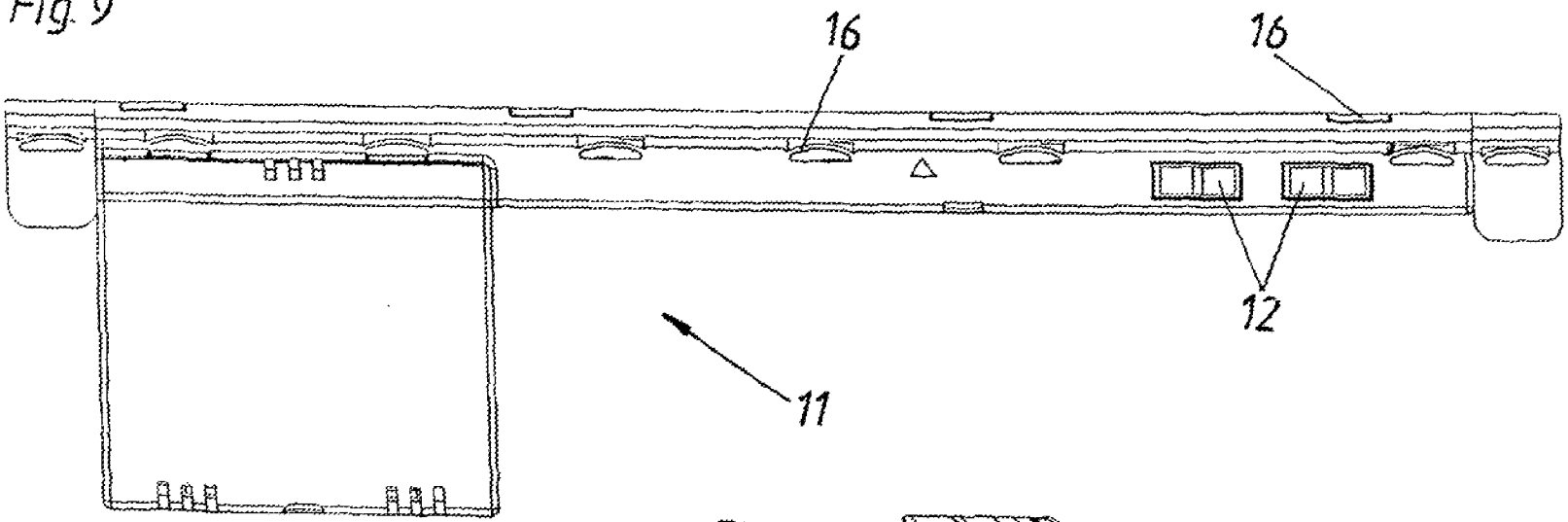
Figure 10:
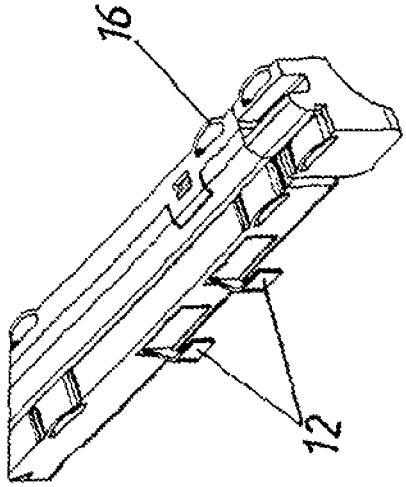

FIG. 5 shows how the power supply units 6 and the only diagrammatically illustrated ejector devices 13 are mounted or clamped to the carrier element 5. In this case, the carrier element 5 has a floor holder 15 and a head side 22 which facilitate mounting to the actual furniture carcass 2. FIG. 6 shows the rear side of the carrier element 5 shown in FIG. 5. The carrier element 5 does not have to be made in one piece. It may also only comprise, for example, two independent profile rails suited for mounting a power supply unit 6.

FIGS. 7 through 10 show various views of a current storage device 11, and the contact locations 12 (in the form of contact hoops 12*a*) which correspond to the contact locations 12 on the power supply unit 6. In addition, the current storage device 11 has clamping elements 16 which facilitate mounting to the movable furniture portion, in particular when at least the mounting region of the furniture portion 3 is in the form of an extruded profile member.

Figure 11:
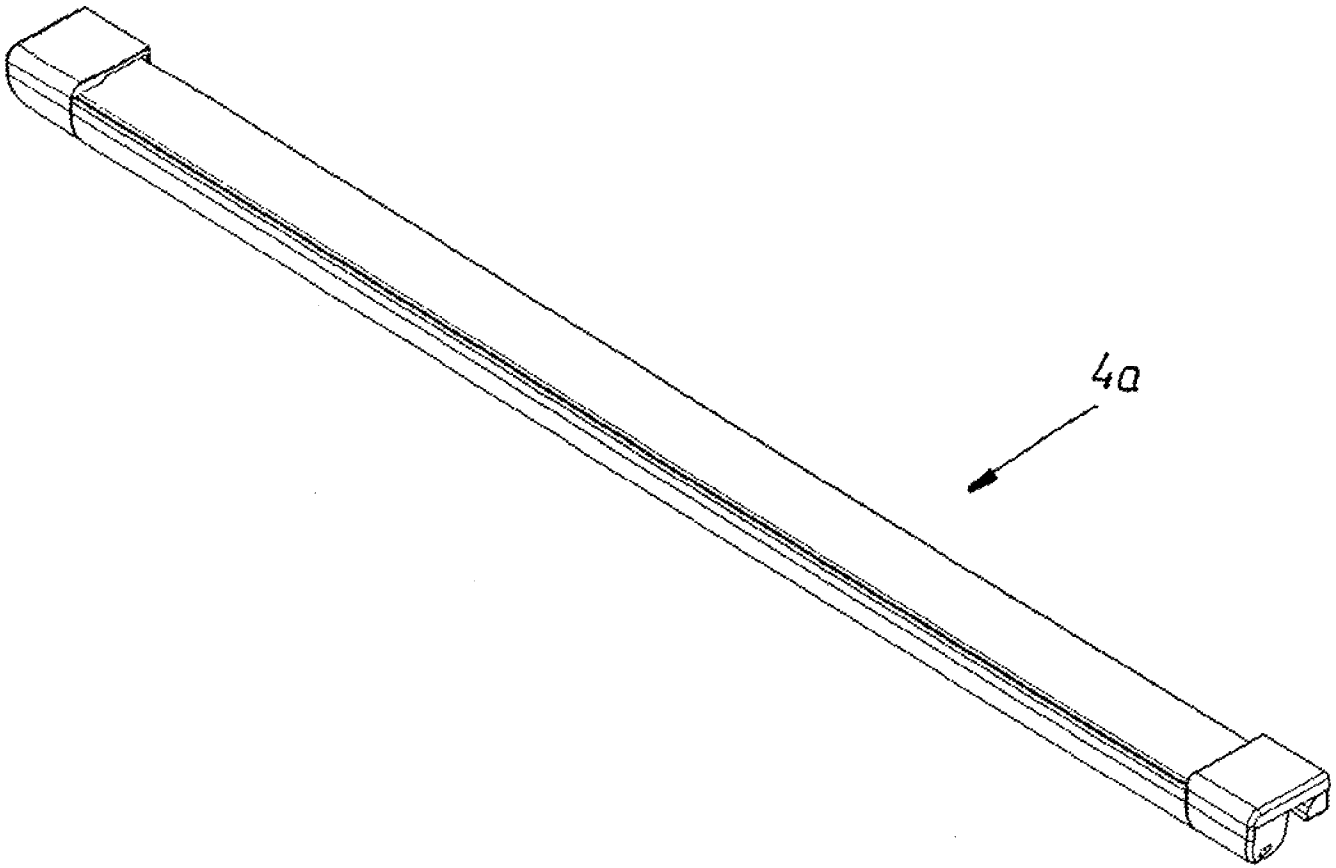
FIGS. 11 through 13 show various views and sections of a lighting device.
Figure 12:
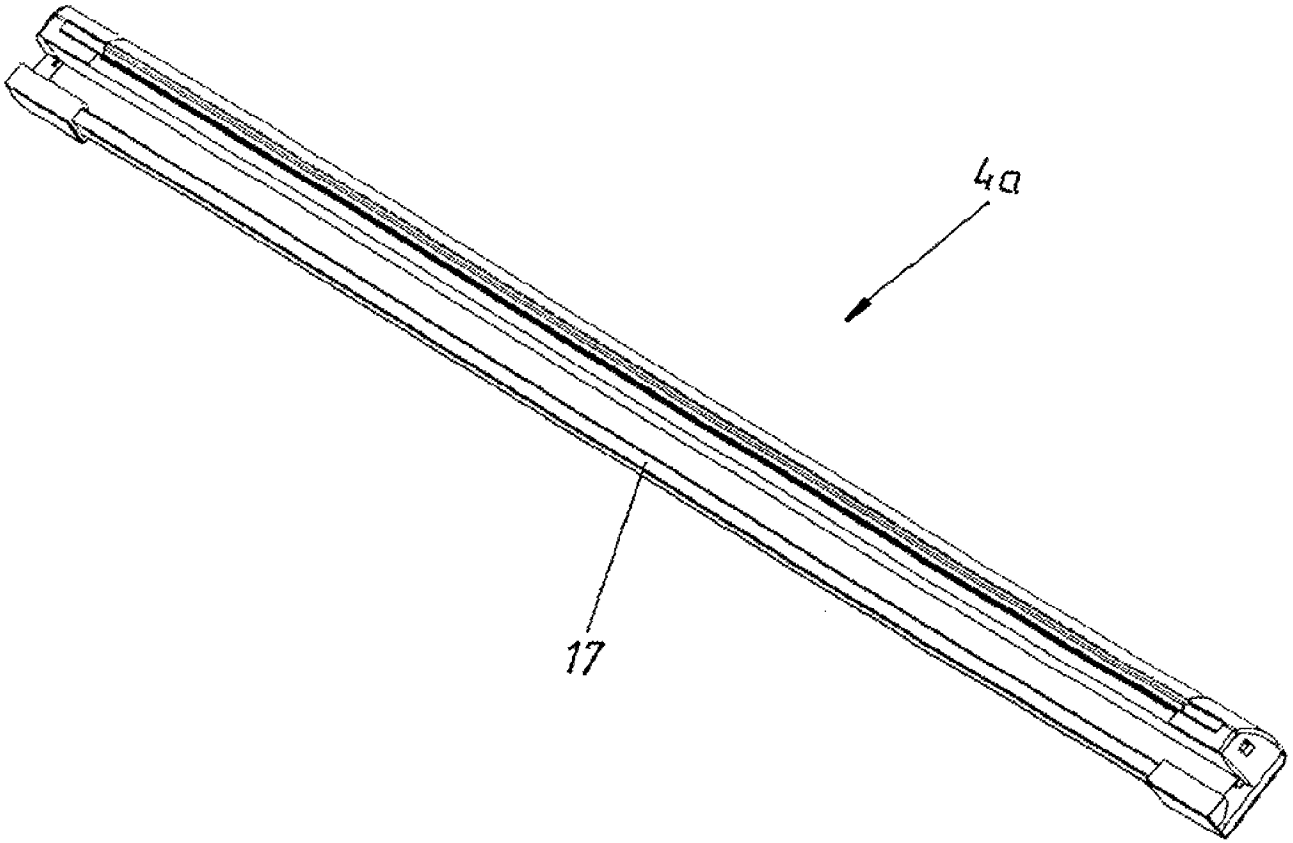
Figure 13:
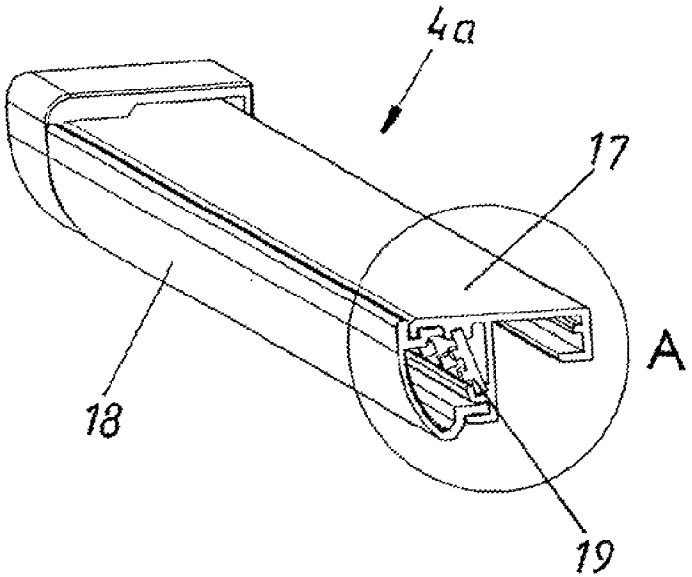
Figure 13:
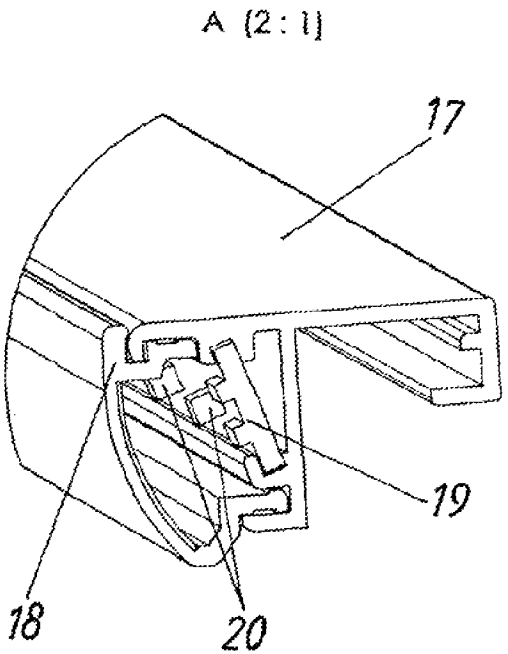

FIGS. 11 through 13 show the current consumer 4 which is in the form of a lighting device 4*a*. The lighting device 4*a* can also be mounted to or suspended from the furniture portion 3 (see, in that respect, the holding bar 17), in which case a current-conducting connection can be provided, for example, by way of a cable with the current storage device 11. The cut-out portion A in FIG. 13 shows a cross-section of the lighting device 4*a*, wherein an LED bar 19 with an LED 20 mounted thereon is arranged in the holding bar 17 (in the form of an extruded profile member), covered by the preferably transparent or translucent cover cap 18.

Figure 14:
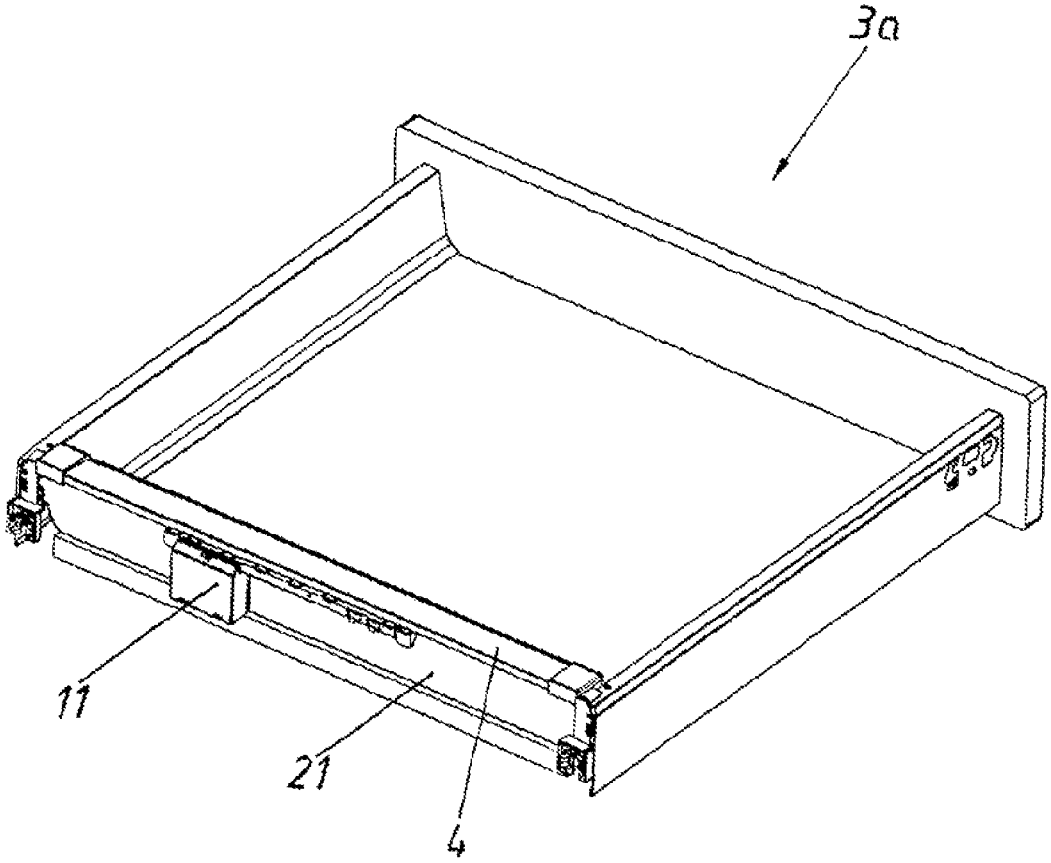
FIGS. 14 through 15 show views and sections of a movable furniture portion with current storage means and current consumer.
Figure 15:
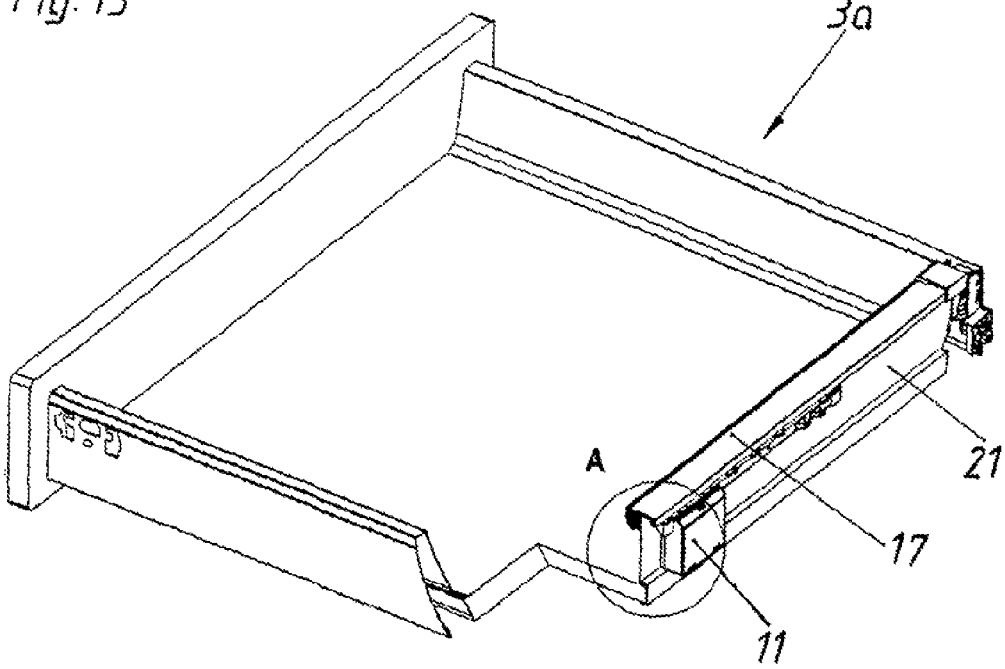
Figure 15:
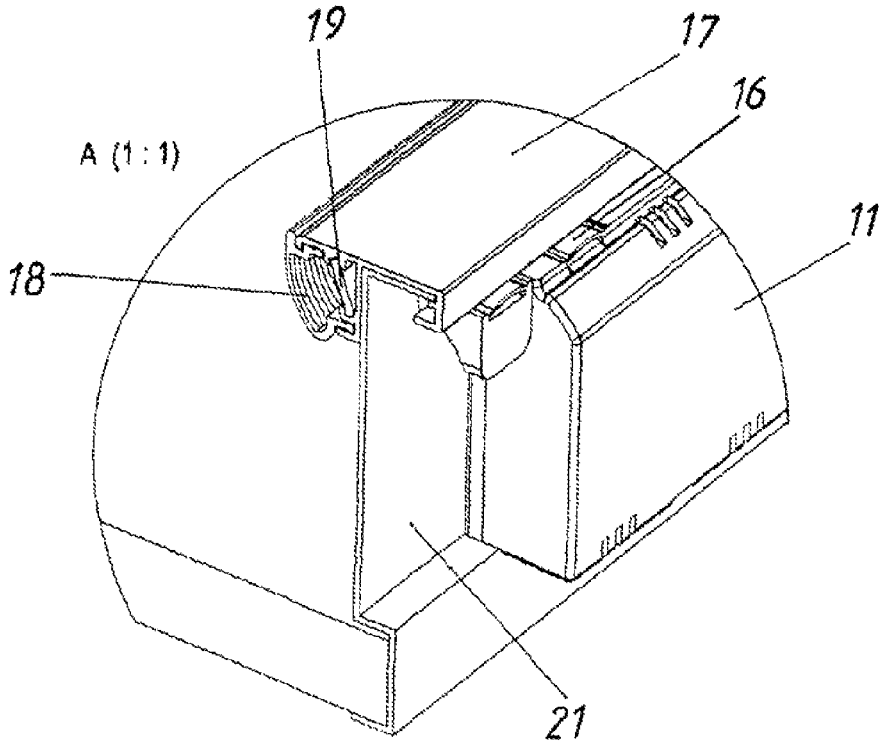
Figure 16:
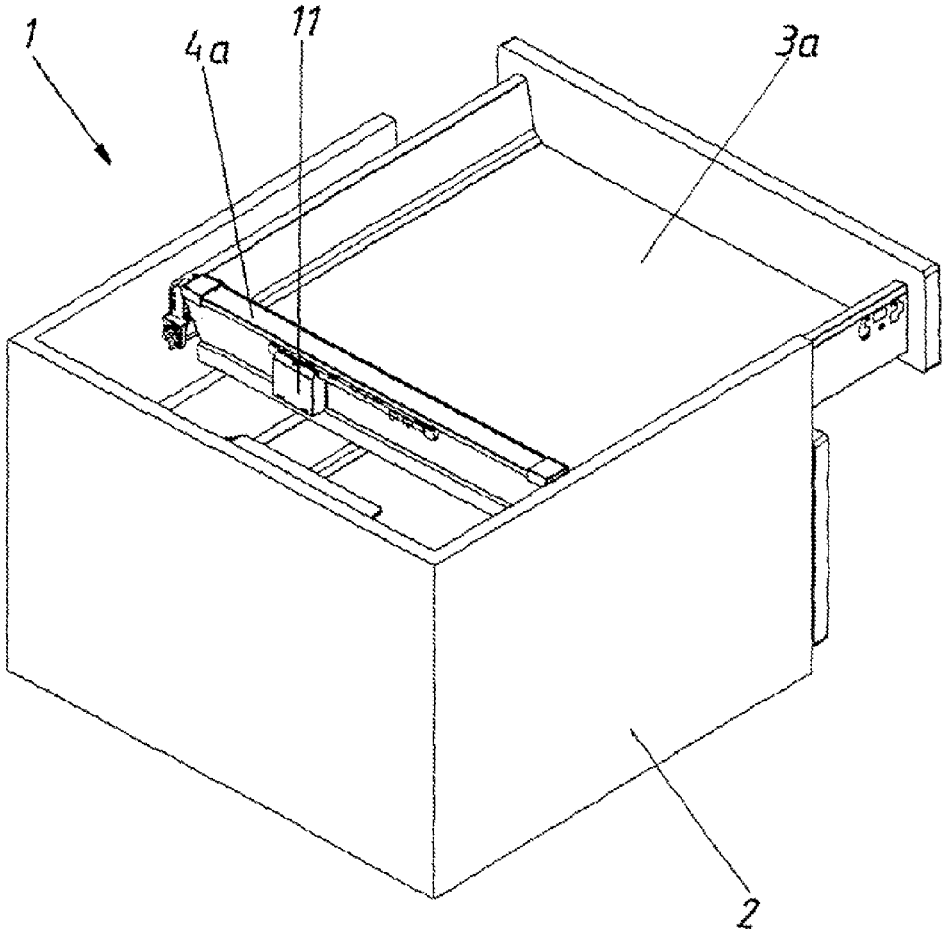
FIGS. 16 through 19 show various views of the movable furniture portion arranged in the furniture carcass.
Figure 17:
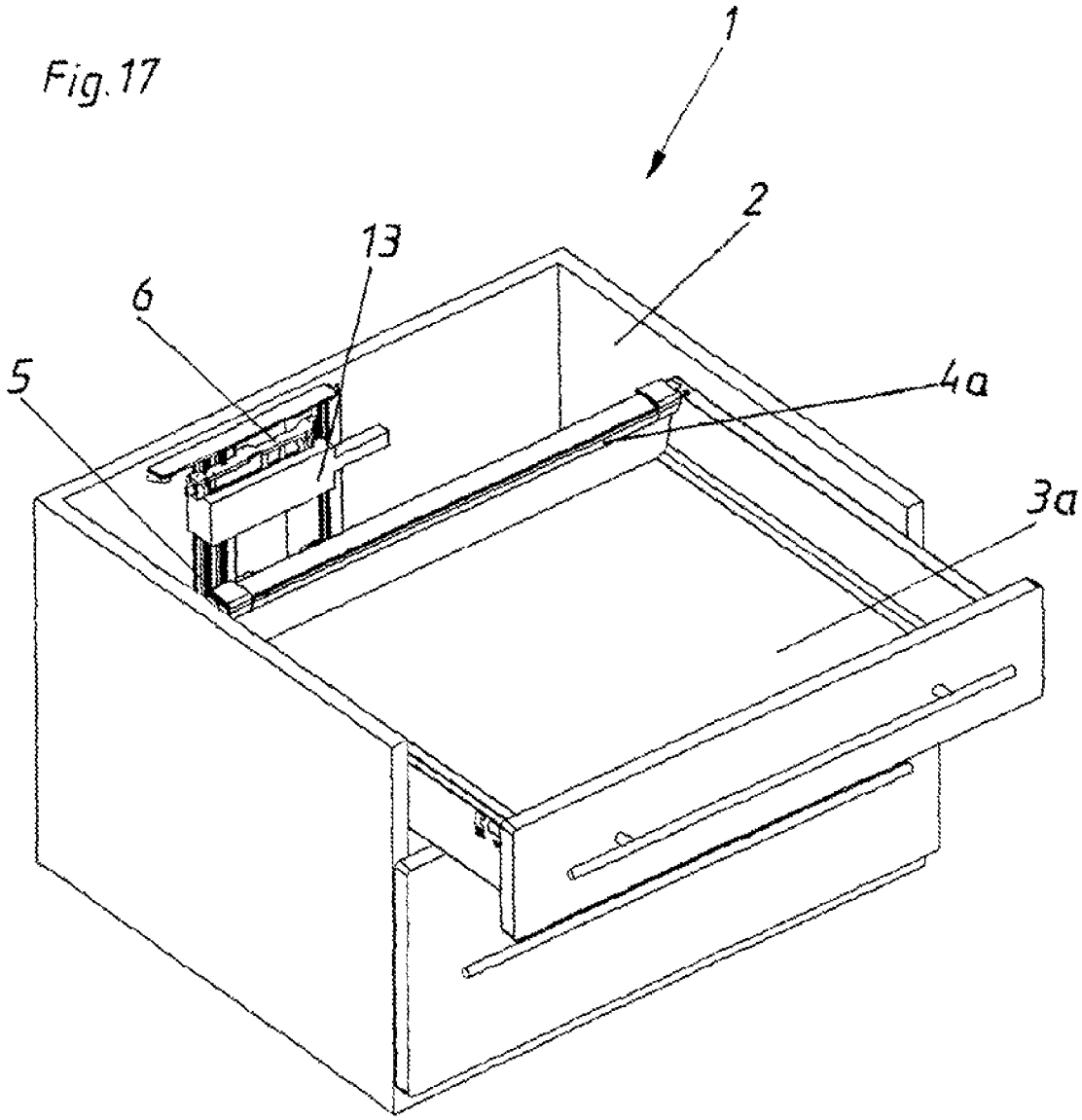
Figure 18:
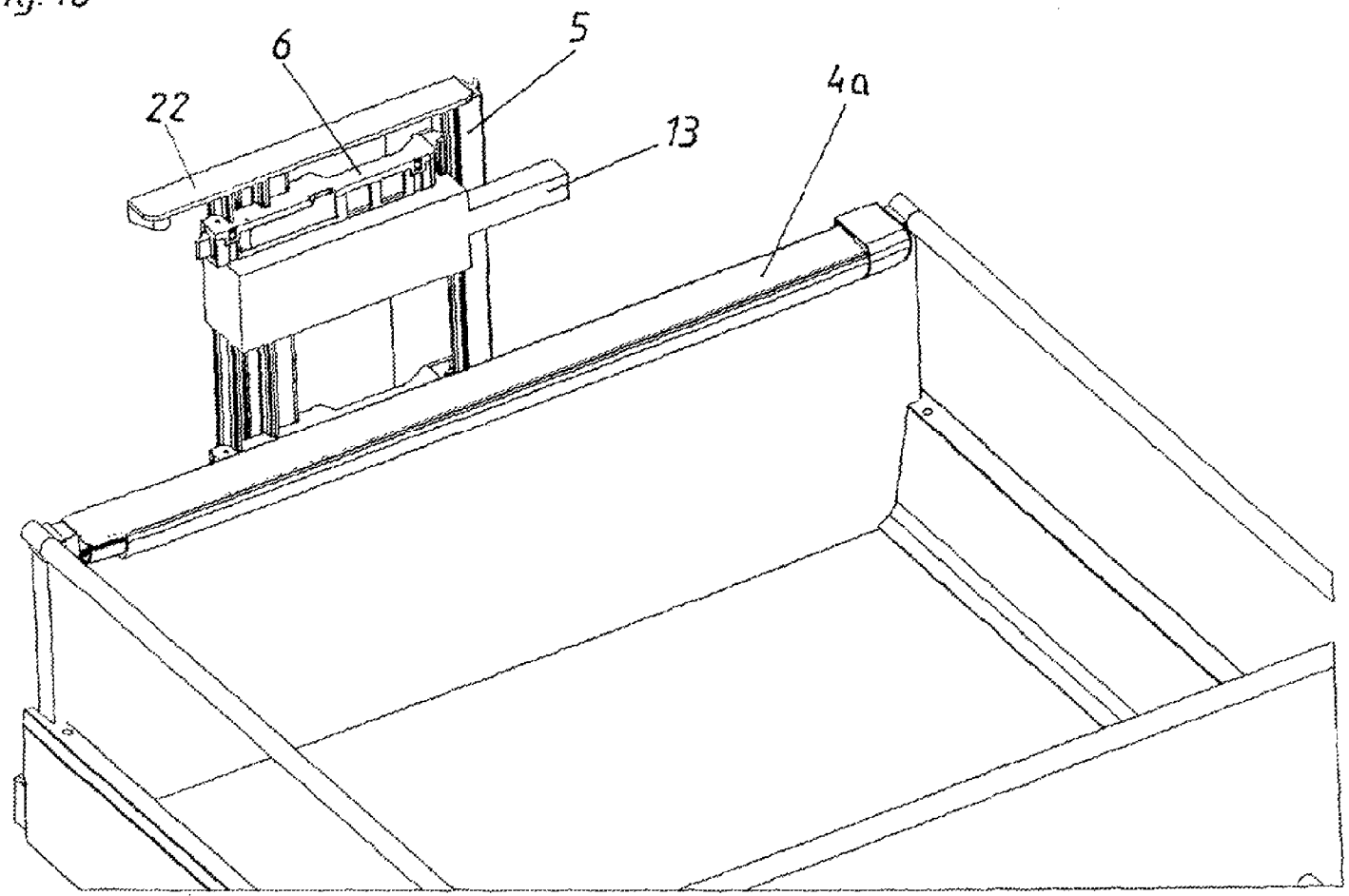

FIG. 14 shows a drawer 3*a* in which the current storage device 11 and the current consumer 4 are arranged on the rear wall 21. The cut-out portion A in FIG. 15 shows the rear wall 21 of the drawer 3*a* in detail, to which both the holding bar 17 together with the LED bar 19 and the cover cap 18 and also the current storage device 11 is suspended or clipped in position with the clamping elements. FIG. 16 shows the drawer 3*a* mounted displaceably in the furniture carcass 2 in the article of furniture. FIG. 17 shows a further view of the drawer 3*a* with a lighting device 4*a* which is arranged in a furniture carcass 2, and a carrier element 5, power supply units 6, and ejector devices 13 in the furniture carcass 2 of the article of furniture. FIG. 18 shows a detail view of FIG. 17.

Figure 19:
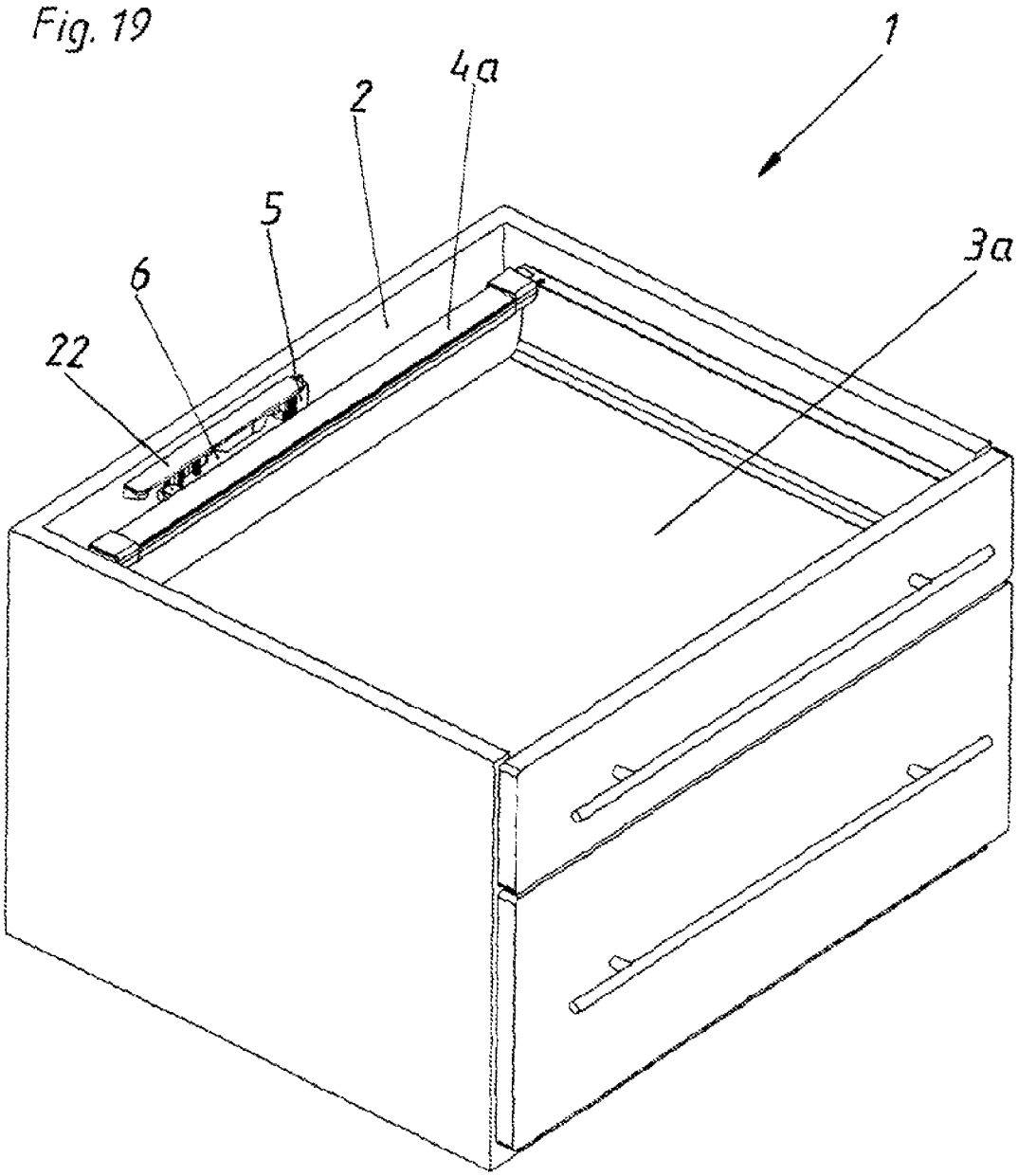
Figure 20:
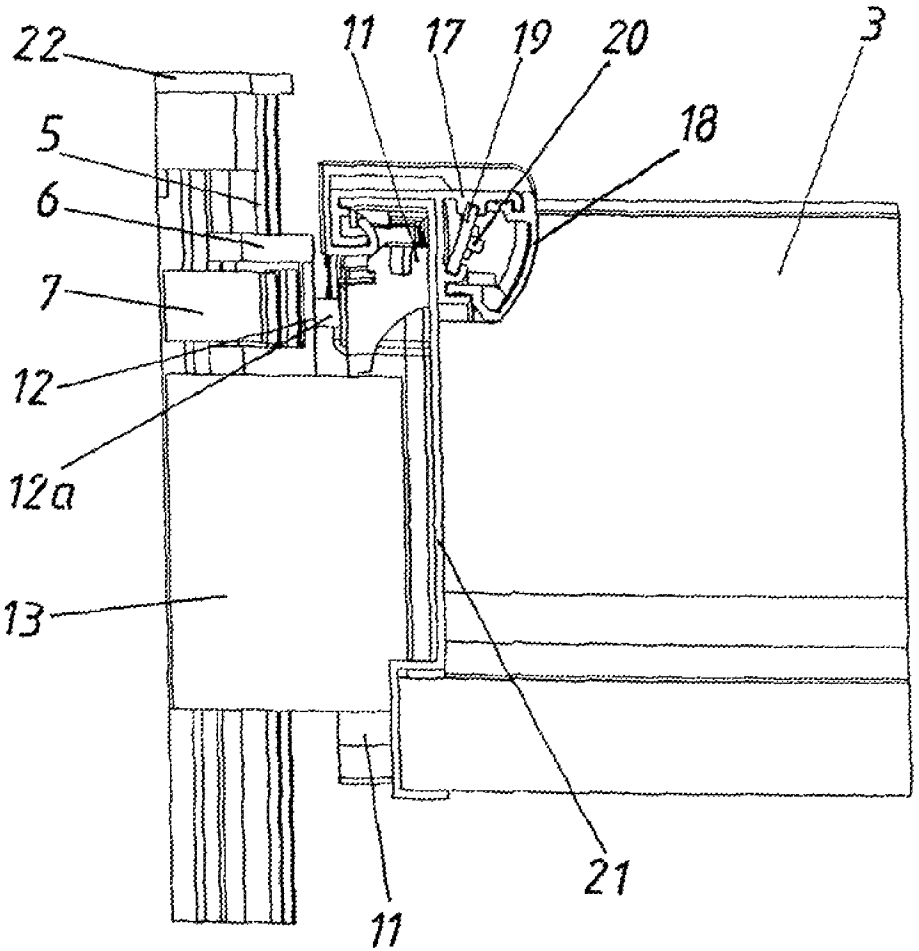
FIG. 20 shows a sectional view of the contact region between a drawer with a current storage means and the power supply unit mounted to the carrier element.

In FIG. 19 the drawer 3*a* is closed. FIG. 20 shows a cross-section through the rear side of the closed movable furniture portion 3 with carrier element 5. The Figure shows, on the one hand, at the drawer side how the current storage device 11 is suspended from or mounted to the rear wall 21 of the movable furniture portion 3, and the holding bar 17 holds the LED bar 19 with the LED 20 and the cover cap 18 on the rear wall 21. On the other hand, mounted to the carrier element 5 are the power supply unit 6 together with clamping stirrup 7 and contact location 12 and the ejector device 13. In that closed condition of the drawer 3*a*, the contact locations 12 and 12*a* respectively of the power supply unit 6 and the current storage device 11 are in contact (electrically engaged). This Figure does not show the current-conducting contact between the current storage device 11 and the current consumer 4, in which respect that can be implemented by contact locations, cables, sliding contacts or similar.

Figure 21:
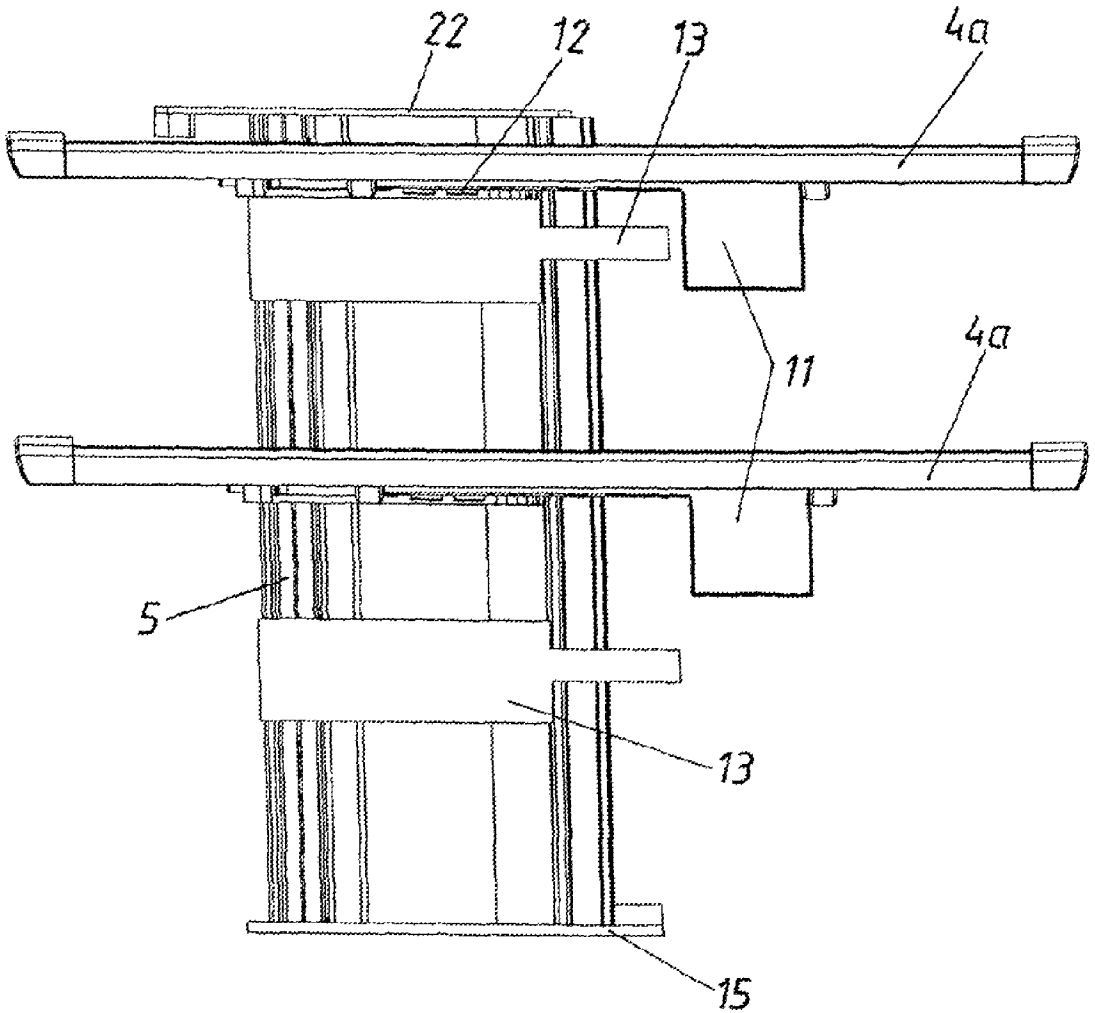
FIGS. 21 and 22 show views of the carrier element with mounted ejectors and power supply units in conjunction with the current storage means and the current consumer.
Figure 22:
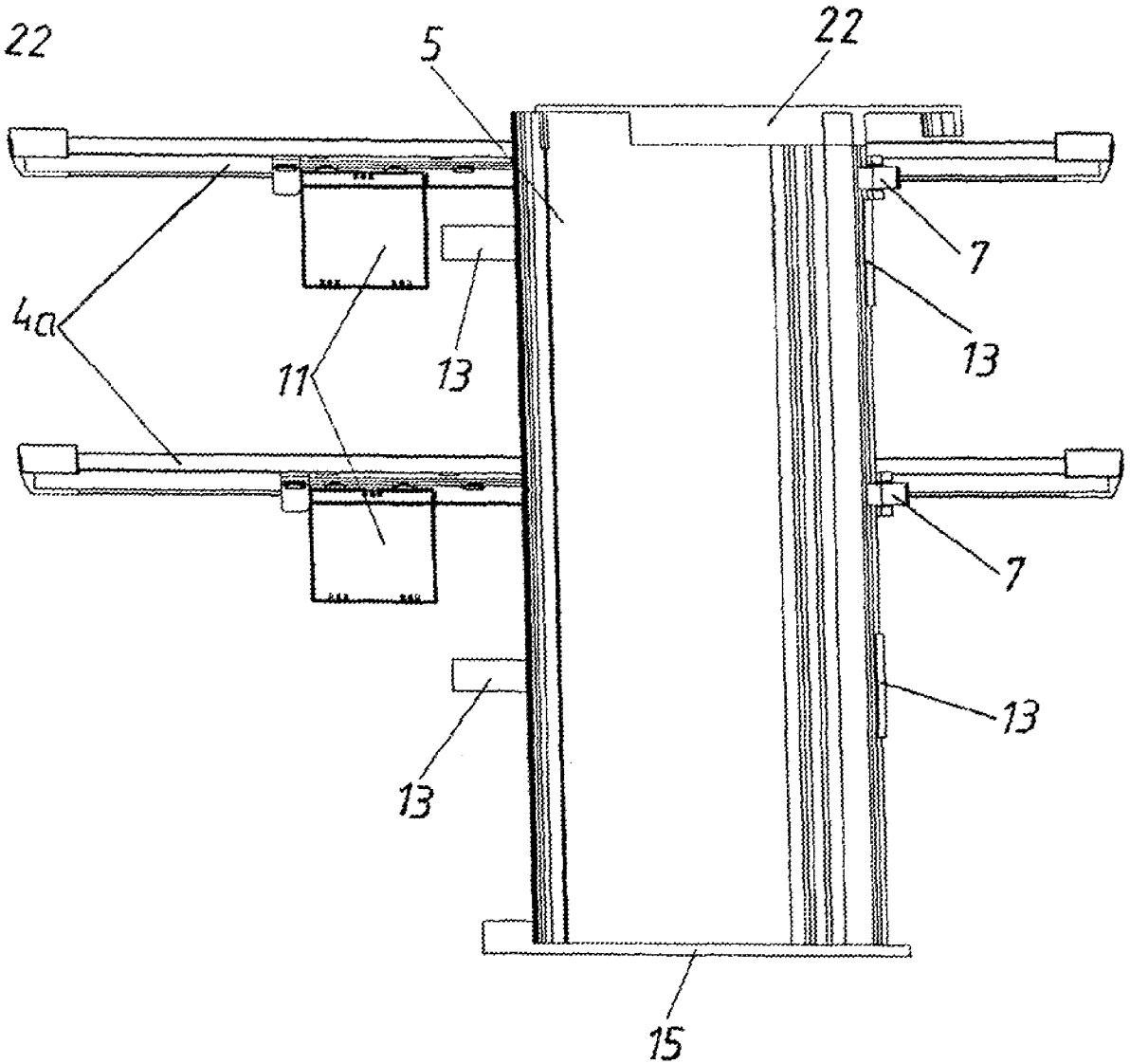

FIGS. 21 and 22 show a front view and a rear view, respectively, of a carrier element 5 with power supply units 6 and ejector devices 13 mounted thereto, without the furniture carcass. The current storage device 11 and the lighting devices 4*a* are also shown, without the movable furniture portion 3. These Figures only serve for illustrative purposes. Specific configurations are meaningful only in conjunction with a furniture portion 3 and a furniture carcass 2.

Figure 23:
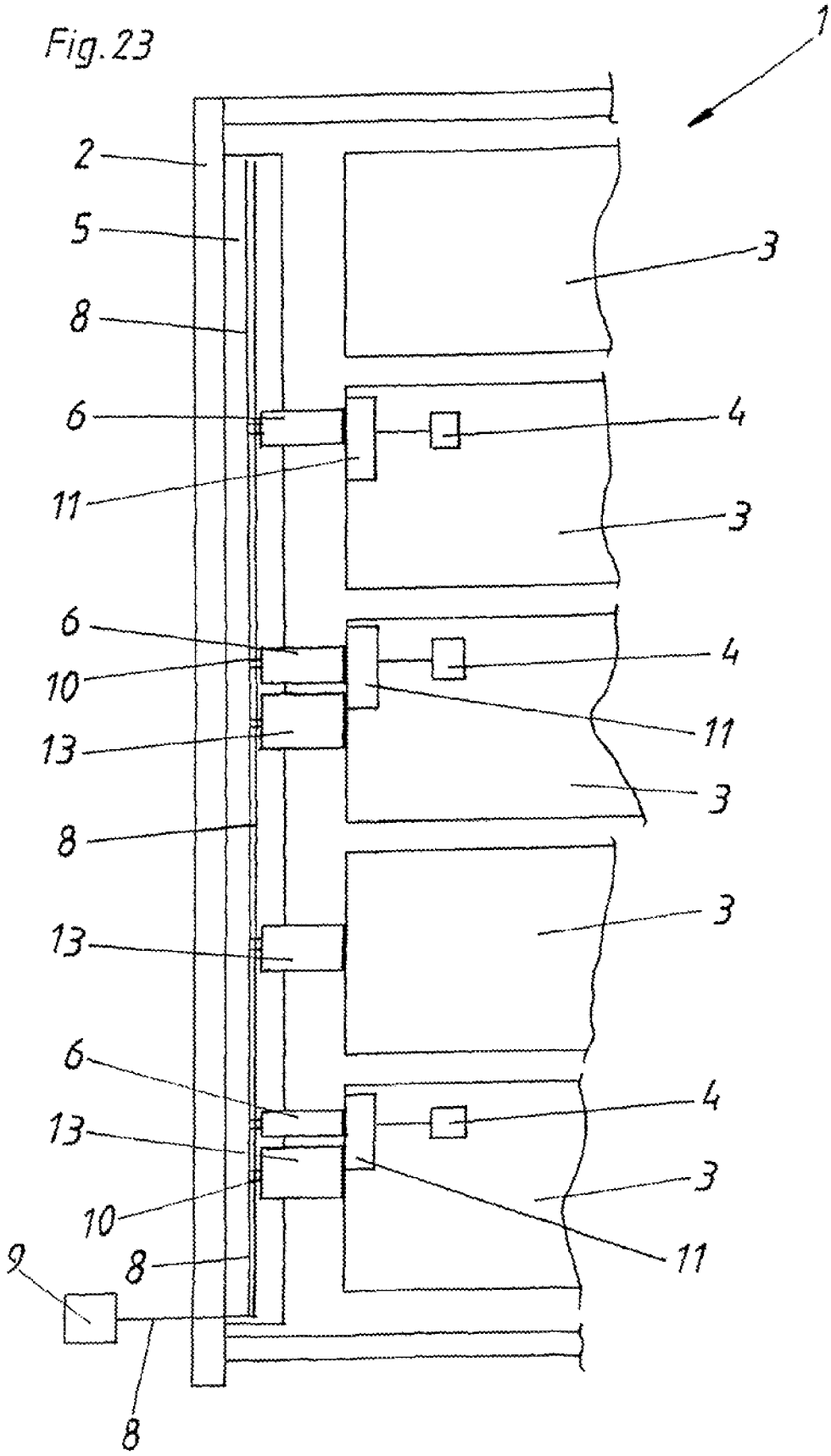
FIG. 23 shows a diagrammatic view of a rear side of an article of furniture according to the invention.

FIG. 23 diagrammatically shows the flow of current between the current source 9 and the current consumer 4 and various modular options in respect of mounting power supply units 6 and ejector devices 13 to the carrier element 5.

The flow of current will be illustrated hereinafter using the example of the lowermost drawer 3. The current passes out of a current source 9 by an electric supply line 8 into a line of the carrier element 5. Such an electric supply line 8 can be, for example, in the form of a two-pole line which is indicated in the carrier element. By way of the piercing pins 10, the ejector device 13 and the power supply unit 6 are automatically in contact with the electric supply line 8 in the carrier element 5 when the ejector device 13 and power supply unit 6 are mounted to the carrier element 5 (other contacting options are also readily conceivable). As, for example, in FIG. 20, the power supply unit 6 contacts the current storage device 11 arranged in or on the movable furniture portion 3. The current storage device 11 is, in turn, connected to the current consumer 4 in the movable furniture portion. It is advantageously provided that each drawer 3 corresponds both to a power supply unit 6 and also to an ejector 13. Alternatively, however, it is also possible to provide different variants as the other drawers in FIG. 23 show. That additionally emphasises the modular versatility and at the same time uncomplicated and simple mounting for the current supply for drawers afforded by the present invention.

The invention claimed is:

1. An article of furniture comprising:

a furniture carcass;

a carrier element mounted to said furniture carcass, said carrier element having an electric supply line extending along a longitudinal axis of said carrier element, said electric supply line being connected to an external current source;

a movable furniture portion movable with respect to said furniture carcass;

a current consumer mounted to said movable furniture portion;

a power supply unit releasably mounted to said carrier element at any location along said electric supply line extending along said longitudinal axis of said carrier element, said power supply unit including piercing pins configured to contact said electric supply line when said power supply unit is releasably mechanically attached to said carrier element so that said power supply unit is automatically electrically connected to said electric supply line;

an ejector device releasably mounted to said carrier element, said ejector device being configured to move said movable furniture portion, and said ejector device having piercing pins for contacting said electric supply line;

a chargeable current storage device mounted to said movable furniture portion;

wherein said power supply unit and said current storage device are configured such that:

when said movable furniture portion is in a closed position, said power supply unit electrically connects to said current storage device so as to electrically charge said current storage device; and when said movable furniture portion is in an opened position, said power supply unit electrically disconnects from said current storage device; and wherein said current storage device is electrically connected to said current consumer so as to supply said current consumer with electric current when said movable furniture portion is in the opened position.

2. The article of furniture of claim 1, wherein said power supply unit has a clamping stirrup for releasably mounting said power supply unit to said carrier element.

3. The article of furniture of claim 1, wherein said current consumer is a lighting device.

4. The article of furniture of claim 3, wherein said lighting device is configured to entirely light up an internal space of said movable furniture portion.

5. The article of furniture of claim 3, wherein said movable furniture portion is a drawer, said lighting device being arranged at a rear wall of said drawer.

6. The article of furniture of claim 1, wherein said power supply unit is configured to charge up said current storage device only in the closed position of said movable furniture portion.

7. The article of furniture of claim 1, wherein said ejector device is spring-loaded.

8. The article of furniture of claim 1, wherein said ejector device is electrically driven.

9. The article of furniture of claim 1, wherein said ejector device is releasably mounted to said carrier element such that, when said ejector device is releasably mechanically attached to said carrier element, said ejector device is automatically electrically connected to said electric supply line mounted to said carrier element.

10. The article of furniture of claim 1, wherein said ejector device and said power supply unit carried by said carrier element are both associated with said movable furniture portion.

11. The article of furniture of claim 1, wherein said movable furniture portion comprises a first movable furniture portion movable relative to said furniture carcass, said current storage device comprises a first current storage device mounted to said first movable furniture portion, and said power supply unit comprises a first power supply unit releasably mounted to said carrier element such that, when said first power supply unit is releasably mechanically attached to said carrier element, said first power supply unit is automatically electrically connected to said electric supply line of said carrier element, wherein said first power supply unit and said first current storage device are configured such that:

when said first movable furniture portion is in a closed position, said first power supply unit electrically connects to said first current storage device so as to electrically charge said first current storage device; and when said first movable furniture portion is in an opened position, said first power supply unit electrically disconnects from said first current storage device, further comprising:

a second movable furniture portion movable relative to said furniture carcass;

a second current storage device mounted to said second movable furniture portion; and a second power supply unit releasably mounted to said carrier element such that, when said second power supply unit is releasably mechanically attached to said carrier element, said second power supply unit is automatically electrically connected to said electric supply line of said carrier element, wherein said second power supply unit and said second current storage device are configured such that:

when said second movable furniture portion is in a closed position, said second power supply unit electrically connects to said second current storage device so as to electrically charge said second current storage device; and when said second movable furniture portion is in an opened position, said second power supply unit electrically disconnects from said second current storage device.

* * * * *